US006295987B1

(12) United States Patent
Parker et al.

(10) Patent No.: US 6,295,987 B1
(45) Date of Patent: Oct. 2, 2001

(54) MEDICAL LIMB REST

(76) Inventors: Elinor S. Parker, 8807 Valley View La., Houston, TX (US) 77074; Shelley Kelley, 4419 Shalom Creek, Spring, TX (US) 77388

( * ) Notice: Subject to any disclaimer, the term of this patent is extended or adjusted under 35 U.S.C. 154(b) by 0 days.

(21) Appl. No.: 09/398,115

(22) Filed: Sep. 16, 1999

(51) Int. Cl.[7] ..... A61G 15/00
(52) U.S. Cl. ..... 128/845; 108/116
(58) Field of Search ..... 128/845, 846, 128/877, 869, 870; 297/7, 19, 24, 53; 108/118, 116; 5/646, 647, 648

(56) References Cited

U.S. PATENT DOCUMENTS

| | | | | |
|---|---|---|---|---|
| 239,876 | | 4/1881 | Stark . | |
| 600,148 | * | 3/1898 | Hanger . | |
| 1,209,679 | * | 12/1916 | Decker . | |
| 1,369,944 | * | 3/1921 | Springer . | |
| 1,556,172 | * | 10/1925 | Spear . | |
| 2,874,003 | | 2/1959 | Humphries | 304/5 |
| 3,528,717 | | 9/1970 | Kinnebrew | 312/237 |
| 4,249,749 | | 2/1981 | Collier | 280/35 |
| 5,111,808 | * | 5/1992 | Meals | 128/845 |
| 5,287,643 | | 2/1994 | Arizpe-Gilmore | 42/94 |
| 5,449,221 | | 9/1995 | Stander | 297/423.4 |
| 5,483,901 | | 1/1996 | Tisbo et al. | 108/119 |
| 5,746,138 | | 5/1998 | Hirose | 108/145 |
| 5,865,127 | | 2/1999 | Carter | 108/115 |

* cited by examiner

*Primary Examiner*—Michael A. Brown
(74) *Attorney, Agent, or Firm*—Jo Katherine D'Ambrosic

(57) ABSTRACT

A medical limb rest for elevating a body appendage including sterilized components. The sterilized components can comprise a support tray having a top surface and an underside. The top surface of the support tray forms a concave section. Preferably, the support tray can have a first edge, a second edge opposite the first edge, and two side edges. The first edge is curved towards the underside to define a first groove and the second edge is curved toward the underside to define a second groove. Other components of the medical limb rest comprise at least two pairs of legs, a first pair and a second pair. The first pair of legs includes a first leg pivotally connected to a second leg and the second pair of legs comprise a third leg pivotally connected to a forth leg. Each pair of pivotally connected legs is attached to another pair of pivotally connected legs by one or more trusses. A first truss connects the top end of the first leg to the top end of the third leg and a second truss connects the top end of the second leg to the top end of the fourth leg. Preferably, the trusses are precisionally machined to snugly fit within the grooves. The supporting legs of the limb rest can also comprise a set of one piece frames.

20 Claims, 6 Drawing Sheets

MEDICAL LIMB REST

FIELD OF THE INVENTION this invention relates to a medical limb rest for elevating body parts, arms, shoulders, legs or head, for example, during medical or surgical procedures. Particularly to a medical limb rest that is adjustable as to height.

BACKGROUND OF INVENTION

In performing medical surgical procedures, it is often necessary to elevate limbs or other body appendages. Raising a body part is required for changing dressing, performing surgery, placing a cast or ease in bandaging. Elevation of a limb is sometimes necessary to facilitate healing or improved blood circulation. Hospitals and medical facilities have used various methods to raise and support a body appendage. The simplest method is having the doctor's assistant or surgical nurse holds the limb or appendage off the operating or examining table during the treatment. A "Chinese finger trap" is used in some hospitals. One end of the Chinese finger trap is attached to a finger or toe and the limb is raised off the table by a hook attached to the other end of the Chinese trap. Another device for raising a body part is a shoulder suspension kit. The shoulder suspension kit uses a mitten and a shoulder holder attached to a hook. A saw horse with rubber padding has also been used to hold up a leg or arm during a medical procedure such as changing a cast. During any of these procedures, and especially during surgery, it is critical that the limb be held firmly and steadily.

Adjustable tables are known and used for various industrial and consumer purposes. Tables with folding legs attached to a tabletop are well known, a card table, for example. Tables with two pairs of legs pivoting in a scissors-like action across or axial to each other are also well known, folding TV trays for example. Tisbo, et al., U.S. Pat. No. 5,483,901 disclose a foldable tray table of modular construction with a tray having an underside with a pair of first legs and second legs connected thereto. The upper end of each first leg has a journal pin adapted for being snap-fit between one pair of journal mountings formed on the underside of the tray. A chair mounted adjustable leg support is disclosed in U.S. Pat. No. 5,449,221 to Stander. An adjustable positioning device for industrial purposes utilizing screw mechanisms is disclosed in U.S. Pat. No. 5,746,138 to Hirose.

A height adjustable table with multiple pairs of cross-mounted legs and controlled by pivotally adjustable cross braces is disclosed in U.S. Pat. No. 3,528,717 to Kinnebrew. The height of the collapsible footrest is controlled by a latch mechanism, that when released, allows the footrest to spring upward. A scissor type mobile tool cart is disclosed in U.S. Pat. No. 4,249,749 to Collier. The height of the cart is controlled by a series of lock notches at the lower portion of the cart, allowing the bottom portion of one pair of leg ends to be moved. These legs pivotally adjust with a second group of legs pivotally attached to the bottom of the cart and to the bottom of the cart tray.

What is needed is a medical limb rest that can steadily and securely support a body part or limb in a raised positioned so that surgical or medical treatment can take place. A medical limb rest that can securely and firmly support the body appendage above the operating or examining table without adding stress to the limb would be beneficial.

SUMMARY OF THE INVENTION

During surgery on a leg, arm, or body appendage, it is often necessary to have the limb raised off the operating table for intricate procedures. Raising the limb is also important while changing dressing or setting a cast. During any of these medical procedures, the limb or appendage, such as the arm, thigh or buttocks, must be held securely and steadily. Because a sterile environment is required for most medical procedures, especially surgery, the preferred medical limb rest for use in a medical office or surgical room is sterile.

The present invention is a medical limb rest that is adjustable to different heights, lightweight and easy to assemble, with one hand if necessary, during the hectic pace of surgery. Advantageously, the medical limb rest is manufactured from materials that are strong enough to provide secure support and capable of being sterilized. In one preferred embodiment, the medical limb rest for elevating a body limb is comprised of sterilized components. The sterilized components can comprise a support tray having a top surface and an underside. The top surface of the support tray forms a concave section for supporting the appendage. Preferably, the support tray can have a first edge, a second edge opposite the first edge, and two side edges. In one preferred embodiment, the first edge is curved towards the underside to define a first groove and the second edge is curved toward the underside to define a second groove. Other components of the medical limb rest comprise at least two pairs of legs, a first pair and a second pair, for example. Preferably, the first pair of legs comprise a first leg pivotally connected to a second leg and the second pair of legs comprise a third leg pivotally connected to a forth leg. In one aspect, each of the legs has a top end and a bottom end. Each pair of pivotally connected legs is attached to another pair of pivotally connected legs by one or more trusses. In one preferred embodiment, a first truss connects the top end of the first leg to the top end of the third leg and a second truss connects the top end of the second leg to the top end of the fourth leg. Preferably, the first truss and the second truss are precisionally machined to snugly fit within the grooves.

In another embodiment, the medical limb rest can comprise a support tray with a sterile pad positioned within the concave section of the tray to cushion the limb. In still another preferred embodiment, the medical limb rest further comprises a plate having a top surface and a bottom surface. Preferably, the top surface of the plate is securely attached to the underside of the support tray. The ends of the plate curve inward toward the bottom surface to form a first lip at one end and a second lip at the opposite end of the plate. The first lip and the second lip are precisionally machine to receive either the first truss or the second truss. In this way, the height of the medical limb rest can be adjusted depending on the positioning of the trusses. The height of the limb rest is greater when the trusses are positioned in the grooves of the plate. In one preferred embodiment, the height of the medical limb rest can vary within a range of from about one inch to about twelve inches. Preferably, the height can be within a range of from about two inches to eight inches.

In still another embodiment of the medical limb rest, each leg defines a pivot hole approximately intermediate to the top end and the bottom end of the leg. The limb rest further comprises two or more removable pivot pins configured to be positioned within the pivot holes so that one pivot pin pivotally connect the first leg to the second leg and the second pivot pin pivotally connects the third leg to the forth leg. each leg can define two or more pivot holes so that changing the pivot point can also change the height of the limb rest.

It is noted that the drawings illustrate only some typical embodiments of the invention and are therefore not to be considered limiting of its scope, for the invention will admit to other equally effective embodiments.

DETAILED DESCRIPTION OF THE INVENTION

Figure 1:
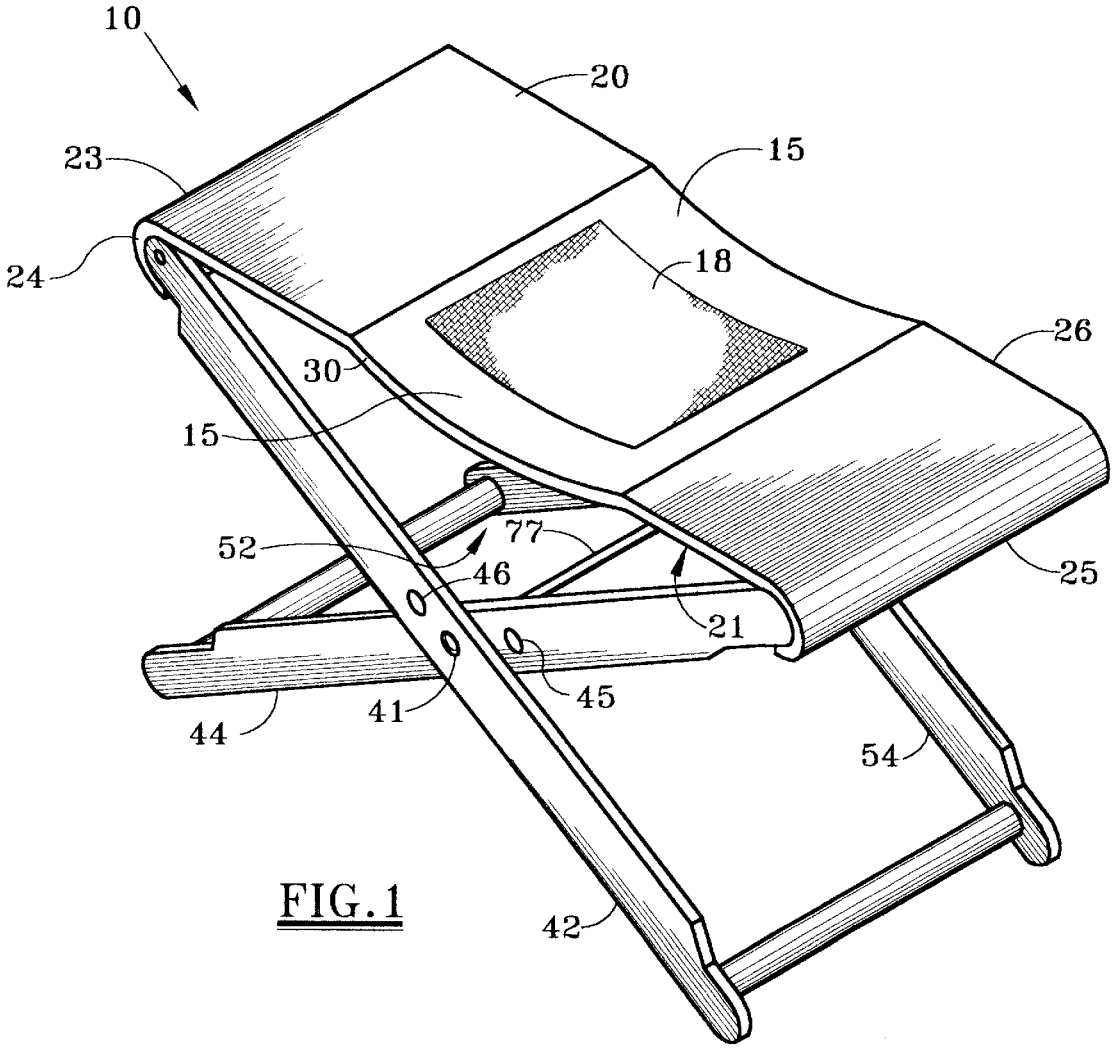
FIG. 1 depicts a perspective view of one embodiment of the present invention.
Figure 2:
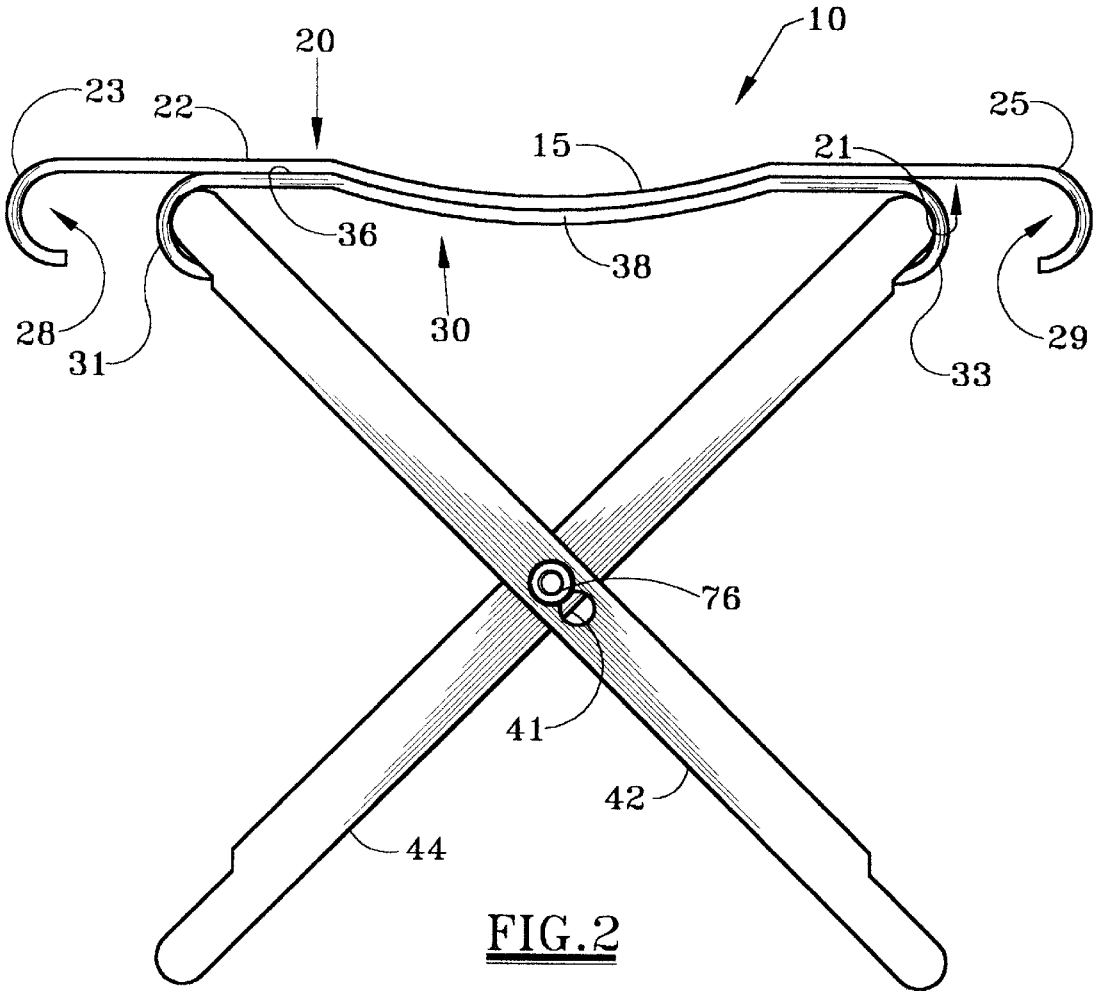
FIG. 2 depicts a side view of the medical limb rest.
Figure 6:
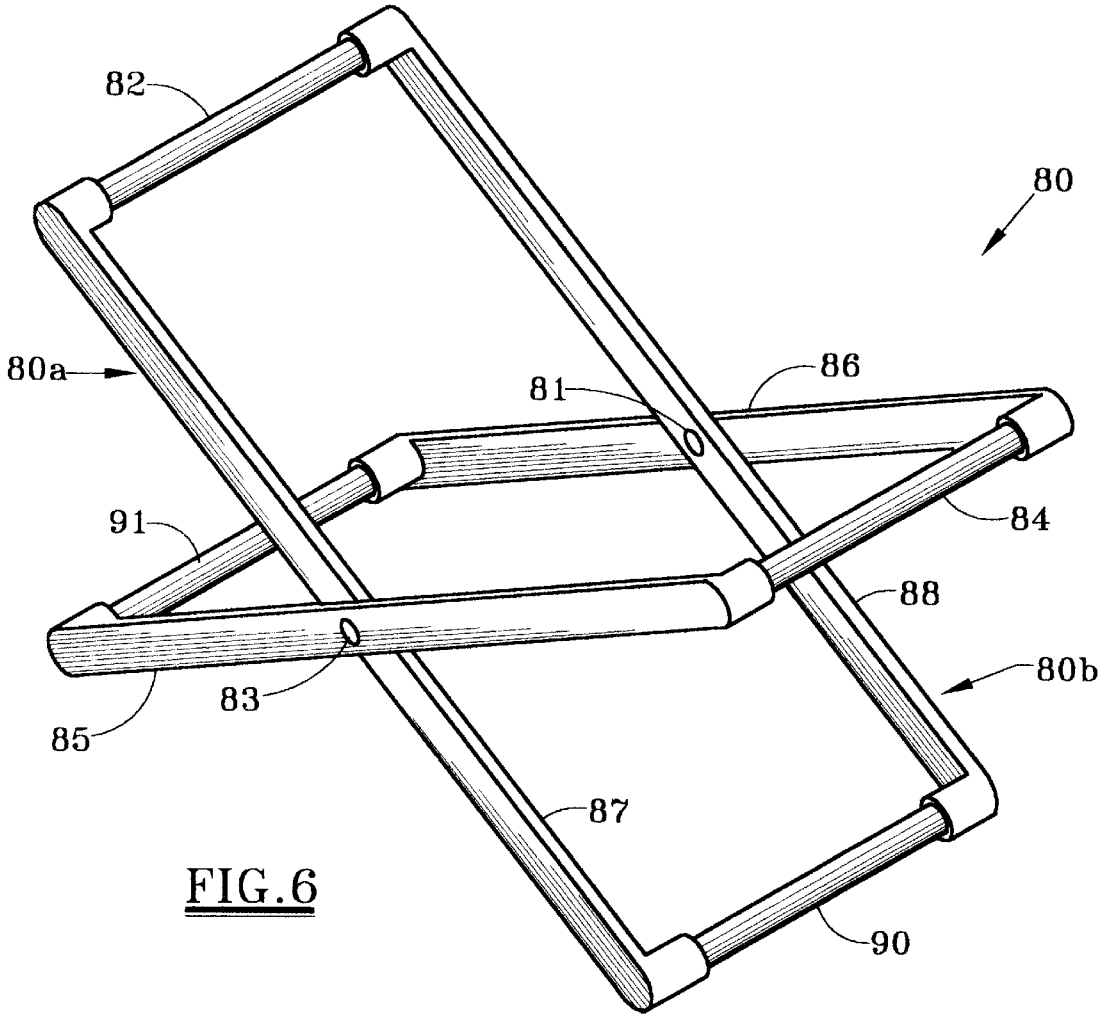
FIG. 6 depicts the supporting legs of another embodiment of the medical limb rest.

The medical limb rest of this invention is adjustable to different heights, lightweight and easy to assemble during the hectic pace of surgery. Advantageously, the medical limb rest is manufactured from materials that are strong enough to provide secure support and capable of being sterilized. Referring to FIGS. 1 and 2, the medical limb rest 10 for elevating a body limb (not shown) is comprised of sterilized components. The sterilized components can comprise a support tray 20 upon which the limb rests and two pairs of pivotally attached legs 40, 50 for holding up the tray 20. Alternatively, two support frames 82, 84 can brace the support tray 20 as shown in FIG. 6. The height of the medical limb rest 10 can be adjusted to accommodate various medical procedures. It is critical that the limb rest 10 be constructed so that it securely and firmly supports the appendage, this is especially important during delicate surgery. The unique structure of the support tray 20, legs 40, 50 and trusses 62, 64 provide firm and sturdy support.

The support tray 20 preferably has a top surface 22 and an underside 21. The top surface 22 defines a concave section 15 upon which a limb can be placed. The support tray 20 has four edges, a first edge 23, a second edge 25 opposite the first edge 23 and two side edges 24, 26. The first edge 23 curves towards the underside 21 to define a first groove 28 and the second edge 25 curves towards the underside 21 to define a second groove 29. It is beneficial for the medical limb rest to be structured to minimize the stress on the supported or elevated limb. To achieve this, the top surface 22 of the support tray is concave as illustrated in FIG. 1, 15 and FIG. 5, 115, to conform to the curvature of the limb or appendage. The concave area 15, 115, as illustrated, is traverse to the length of the tray 20, 120. Alternatively, the concave area of the tray 20, 120 can be longitudinally positioned (not shown). Preferably, the top surface 22 can also be adapted to receive sterilized padding 18. The top surface 22 of the support tray 20 can be modified with commercially available self-sticking materials, such as material sold under the trade mark, VELCRO®, to allow sterilized padding 18 to be secured to the support tray 20. Alternatively, the sterilized padding 18 can be self-adhesive to firmly adhere to the top surface 22. Other methods of adhering the sterilized padding 18 to the top surface are know in the art.

Figure 3:
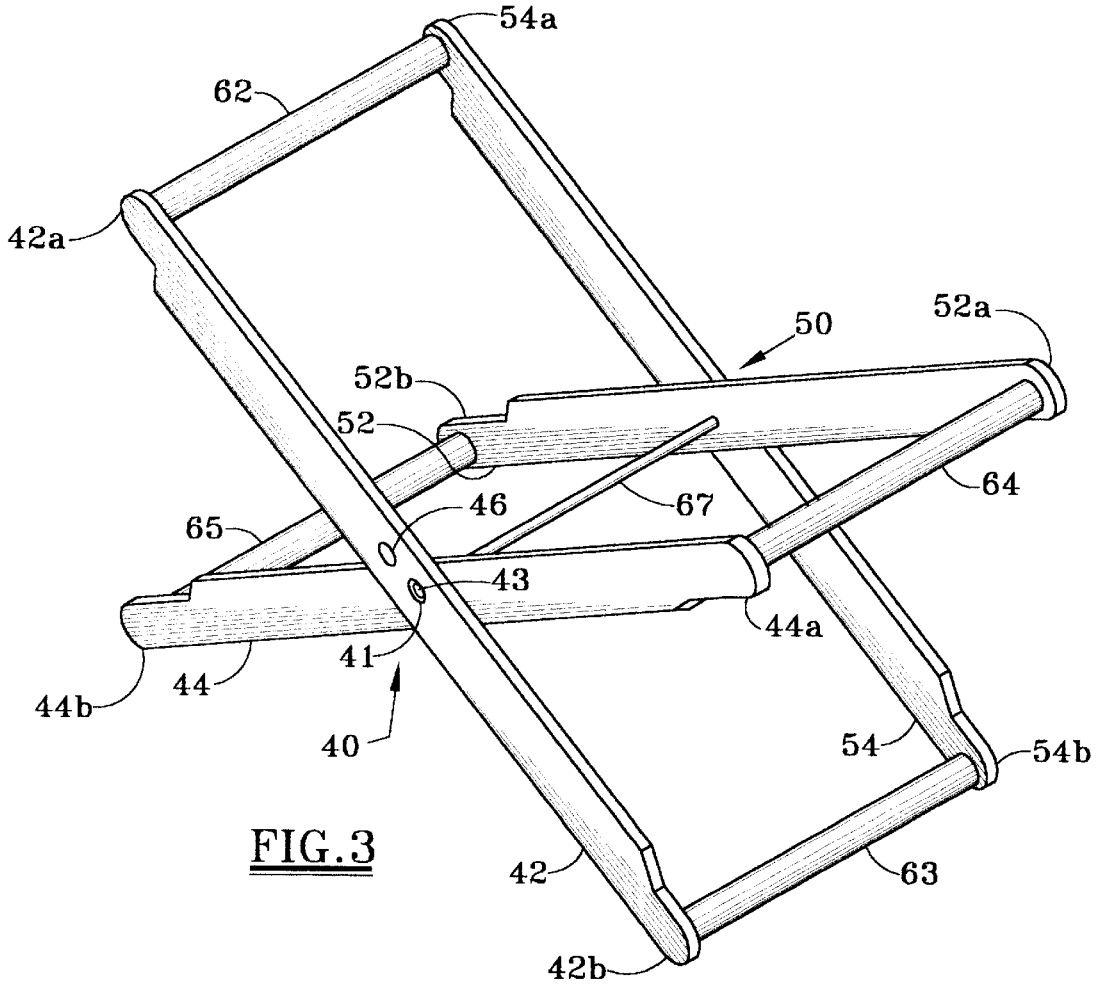
FIG. 3 depicts a perspective view of the legs and trusses of the medical limb rest.

One embodiment of the medical limb rest 10 as illustrated in FIGS. 1 and 3, comprises at least two pairs of legs 40, 50, the first pair of legs 40 comprising a first leg 42 pivotally connected to a second leg 44. The second pair of legs 50 comprises a third leg 52 pivotally connected to a fourth leg 54. Each leg has a top end 42*a*, 44*a*, 52*a*, 54*a* and a bottom end 42*b*, 44*b*, 52*b*, 54*b*. A first truss 62 connects the top end of the first leg 42*a* to the top end of the fourth leg 54*a* and a second truss 64 connects the top end of the second leg 44*a* to the top end of the third leg 52*a*. Because it is important that the medical limb rest 10 be stable and secure, the trusses 62, 64 and grooves 28, 29 of the support tray are precisionally machined, or otherwise manufactured to precisionally accurate dimensions that are complementary. This insures that the trusses 62, 64 snugly fit within the grooves 28, 29, 34, 35 and will not wobble or come apart during use.

The width of the trusses 62, 64 determines the distance between the two pairs of legs and is dependent on the width of the grooves 28, 29, 34, 35. Preferably, the width of the trusses is between one-half and slightly less than equal to the width of the grooves 28, 29, 34, 35 so that trusses 62, 64 form a snug fit when in the grooves 28, 29, 34, 35. The trusses 62, 64 are preferably circular in shape but can be angular depending on the shape of the grooves 28, 29, 34, 35, which can be circular as illustrated in FIGS. 1 and 2 or angular (not shown). To provide sturdy support when the truss 62, 64 is within the groove 28, 29, 34, 35, the groove 28, 29, 34, 35 should circumscribe at least one half of the circumference of the truss 62, 64. In an alternative embodiment as shown in FIG. 3, a third truss 63, connects the bottom end of the first leg 42*b* to the bottom end of the fourth leg 54*b*. and a fourth truss 65 connects bottom end of the second leg 44*b* to the bottom end of the third leg 52*b*. The third truss 63 and the fourth truss 65 are precisionally machined to snugly fit within the grooves 28, 29, 34, 35. If necessary, the tray 20 can be positioned on either end of the legs 40, 50. A fifth truss 67 can also be added for additional structural support of the medical limb rest 10.

Figure 4:
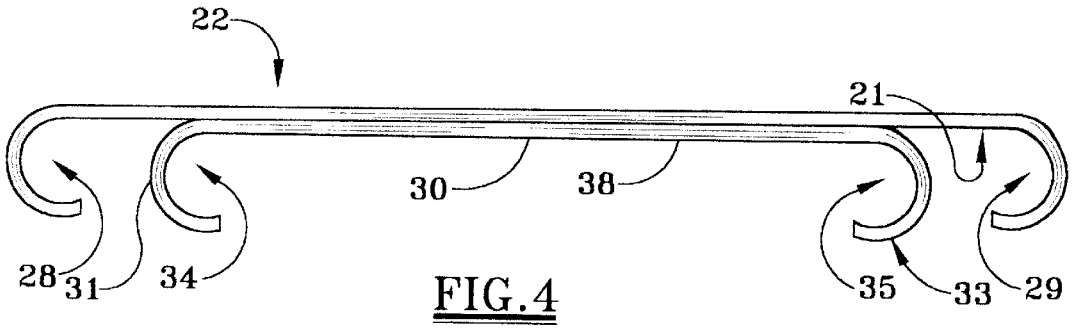
FIG. 4 depicts a side view of the support tray of the medical limb rest of FIG. 2.

The height of the medical limb rest 10 can vary and is dependant upon 1) the length of the legs 42, 44, 52, 54, 2) the position of pivot holes 41, 45, 46 and 3) the distance between each pair of grooves 28, 29, 34, 35. In one embodiment, illustrated in FIGS. 2 and 4, the support tray 20 further comprises a plate 30 attached its underside 21. The plate 30 comprises a top surface 36 and a bottom surface 38, the top surface 36 is securely attached to the underside 21 of the support tray. The plate 30 can be molded to the support tray 20. Alternatively, the plate 30 can be attached by adhesive or nuts and bolts. The plate has a first lip 31 at one end and a second lip 33 at the opposite end. The first lip 31 and the second lip 33 curve inwardly towards the bottom surface 38 forming a third groove 34 and a fourth groove 35. The third groove 34 and fourth groove 35 of the plate are also precisionally machined complimentary to the trusses so that the trusses 62, 64 can firmly and snugly fit within them. The precision fit of trusses 62,63, 64, 65 into grooves 28, 29, 34, 35 forms a sturdy limb rest 10 that will not easily come apart or be unstable during the medical procedure. The height of the limb rest 10 can be lowered by placing the trusses 62, 64 within the grooves 28, 29 of the support tray 20 or raised by placing the trusses 62, 64 within the grooves 34, 35 of the plate 30.

The medical limb rest 10 can be manufactured from any material that is study and capable of being sterilized. Stainless steel, 12 to 22 gauge, is one preferred material. The limb rest 10 can also be molded from a strong, high temperature resistant plastic such as polyurethane or a polytetrafluoroethylene, commercially available under the trade name TEFLON. Alternatively, the support tray 20 can be made from a study fabric. Regardless of the method of manufacturing or materials, the medical limb rest 10 preferably has smooth surfaces without sharp edges that can pierce surgical gloves or injure a patient. An alternative embodiment of the present invention 10 comprises a series of grooves (not shown) that are molded or milled into the underside 21 of the support tray 20.

The medical limb rest 10 can be capable of reuse and may be sterilized using conventional and known sterilization techniques. Preferably, the limb rest 10 is lightweight, collapsible for ease in storage and adjustable in height. The determination of the appropriate height of the limb rest 10 depends on the medical procedure. Preferably, the height can vary within a range of from about one inch to about fourteen inches depending on the length of the legs 42, 44, 52, 54, the distance between the first set of grooves 28, 29 and the distance between the second pair of grooves. In one preferred embodiment the length of the legs is can vary from about 2 inches to about 10 inches, preferably 4 inches to 8 inches. The distance between the first pair of grooves 28, 29 can vary from about 4 inches to about 8 inches, preferably about 5 inches to about 6 inches. The distance of the second pair of grooves can vary from about three inches to about seven inches, preferably about 4 inches to 5 inches. Further variations of these dimensions are within the scope of this invention according to the height required for a specific medical procedure. A height preferred during most medical procedures is within a range of from about two inches to about eight inches.

The height of the medical limb rest 10 can also be a factor of the position of the pivot hole 41, 45, 46. Each leg 42, 44, 52, 54 defines at least one pivot hole 41, 45, 46 between the top end of the leg 42*a*, 44*b*. 52*a*, 54*a* and the bottom end of the leg 42*b*, 44*b*. 52*b*, 54*b*. In one embodiment, the pivot hole 41, 45, 46 of each leg 42, 44, 52, 54 is positioned at a point on the leg 42, 44, 52, 54 that is within the range of approximately 25% to about 75% of the distance from an end of the leg 42, 44, 52, 54. Alternatively, the pivot hole 41, 45, 46 is positioned approximately midway between the ends of the leg 42, 44, 52, 54. Variations in positioning the pivot hole between the 75:25 ratio of distance from the end of the legs 42, 44, 52, 54, are within the scope of this invention. The point of pivot of the legs is one factor in determining the height of the tray 20. Each leg 42, 44, 52, 54 defines one or more pivot holes 41, 45, 46 for receiving a pivot pin 43 as illustrated in FIG. 3. The distances of the pivot holes 41, 45, 46 from the ends of the legs 42*a*, 42*b*, 44*b*. 44*b*. 52*a*, 52*b*, 54*b*. 54*b* can be equal for each leg so that changing the position of the pivot pin 43 to a different pivot hole 41, 45, 46 changes the height of the limb rest.

Figure 7:
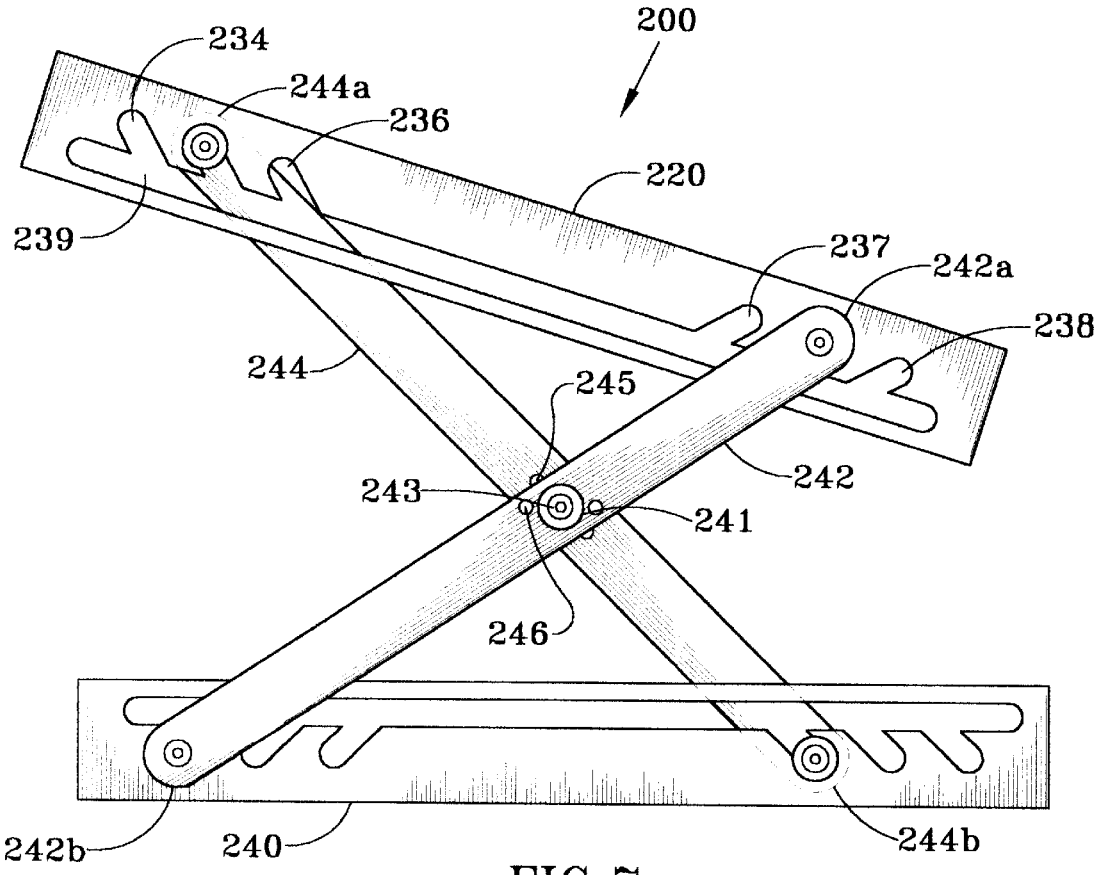
FIG. 7 depicts another embodiment of the medical limb rest that is reversable.

In an alternative embodiment as shown in FIG. 7, the pivot holes 46, 45 on the first leg 242 are positioned at a distance from the end of the legs 242*a*, 242*b* that is a different distance than the position of the pivot holes on the second leg 244. Having the pivot holes 246 and 245 at different distances on the legs 242, 244 allows the medical limb rest 10 to be at a slant or inclined plane. When the tray 20 is snapped onto the legs 242, 244 the tray 220 is at a slant, i.e., not parallel to the surface upon which the medical limb rest 10 is placed. The slanted medical limb rest 10 is necessary in some types of surgery to tilt the limb to prevent blood clots from forming within the limb and also to prevent the cut off of the blood supply to limb during lengthy surgery. Other ways of creating a slanted medical limb rest include varying the length of the legs, or placing the trusses in notches or slots 234, 236, 237, 238 that are not equidistant from the ends of the tray 220.

FIG. 7 illustrates an embodiment of the medical limb rest 200 that comprises two trays 220, 240. The trays 220, 240 can be different sizes, one tray 220, smaller or larger than the other tray 240, to easily accommodate different sized limbs. In this embodiment, the limb rest 200 can be reversed by flipping it over to accommodate different requirements of height or size during the medical procedure. Additionally, a tray at either end provides greater stability for the limb rest 200 while resting on a surface, the operating table for example.

Referring to FIG. 1, the limb rest 10 preferably has two or more removable pivot pins 43 configured to be positioned within the pivot holes 41, 45, 46 so that one pivot pin 43 pivotally connects the first leg 42 to the second leg 44 and a second pivot pin (not shown) pivotally connects the third leg 52 to the fourth leg 54. The pivot pin 43 can be a snap rivet. Alternatively, as shown in FIG. 2, the pivot pin 76 can comprise a quick release spring/ball assembly 76 that can be quickly inserted or shifted between different pivot holes 41, 45, 46 as depicted in FIG. 1. In still another alternative embodiment illustrated in FIG. 1, the pivot pin comprises a single pivot shaft 77 that is inserted into each pivot hole 41, 45 thereby connecting all of the legs 42, 44, 52, 54 to each other. To facilitate the ease and quickness of assembly and adjustment of the height of the medical limb support, the pivot pins 43, 45 must be readily removed from one pivot hole 41 and be easily inserted in an alternate pivot hole 46. A spring action pivot pin can be used so that the limb rest 10 springs open and is ready for use when the packaging is opened.

Figure 5:
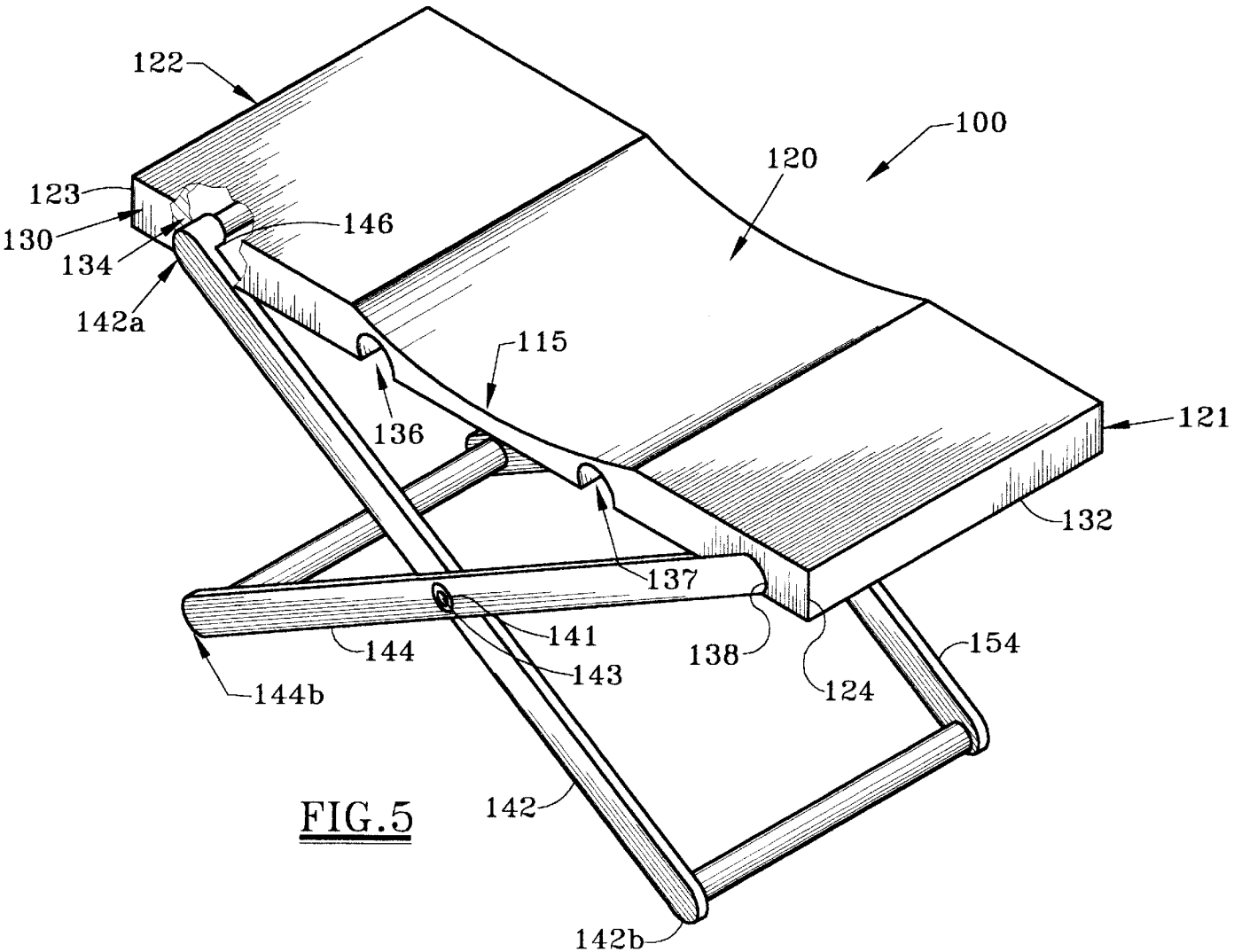
FIG. 5 depicts a perspective view of another embodiment of the present invention.

Another preferred medical limb rest 100 for elevating a body appendage is illustrated in FIG. 5. The sterilized components of this embodiment include a support tray 120 having a top surface 122 and an underside 121. The top surface 122 defines a concave section 115 for supporting the appendage. Preferably, the support tray 120 has four edges perpendicular to the top surface 122, a first edge, a second edge opposite the first edge 124 and two side edges, a first side edge and a second side edge. The first side edge 123 forms a first rim 130 perpendicular to the top surface and the second side edge forms a second rim perpendicular to the top surface (not shown). The rims 130 defines one or more slots 134, 136 positioned adjacent the first edge and one or more slots 137, 138 positioned adjacent the second edge 124. The slots receive the trusses 146, 148 when the limb rest 10 is assembled. The distances of the slots 134,136 from the first edge 123 are equal to the distances of the slots 137, 138 from the second edge 124. The second rim (not shown) opposite the first rim 130 defines one or more slots positioned adjacent the first edge and one or more slots positioned adjacent the second edge. The distances of the slots of the second rim from the first edge being equal to the distance of the slots from the second edge. The distance of the slots from either the first edge or the second edge on the first rim are equal to the distances of the slots from either the first edge or the second edge on the second rim so that the equidistant slots on each rim form a pair of slots for receiving trusses connecting the legs of the limb rest 100.

Preferably, the medical limb rest 100 as illustrated in FIG. 5, has at least two pairs of legs, a first pair of legs 142, 144 and a second pair 154 (partially shown), the first pair of legs comprises a first leg 142 pivotally connected to a second leg 144. The second pair of legs comprises a third leg 152 pivotally connected to a fourth leg 154; each of the four legs having a top end and a bottom end. A first truss 146 connects the top end of the first leg 142*a* to the top end of the third leg and a second truss 148 connects the second leg 144*a* to the top end of the fourth leg. The first truss 146 engages with one of the pair of slots 134, (not shown) positioned adjacent the first edge 123. The slots 134 are equidistant from the first edge 123 and the second truss 148 for engaging with a pair of slots 138 (not shown) positioned adjacent the second edge 124 and equidistant from the second edge 124 such that engaging the truss with the slots at varying distances from the edges varies the height of the tray.

Preferably, each leg 142, 144 defines at least one pivot hole 141 adapted to receive a pivot pin 143. The distances of the pivot holes 141 from the ends of each of the legs 142, 144 being equal so that changing the position of the pivot pin to a different pivot hole changes the height of the limb rest 100. In another preferred embodiment of the medical limb rest for elevating a body appendage, trusses are not provided. The ends of the legs are adapted to be inserted within the slots 134, 136, 137, 138 of the support tray 120. In this embodiment, the top ends legs are precisionally machined to snugly fit within the slots 134, 136, 137, 138.

FIG. 6 illustrates another embodiment of the medical limb rest 80 that uses frames 80*a*, 80*b* as the supporting members for the support tray 20. The medical limb rest 80 comprises sterilized components including a support tray as shown in FIG. 1, 20, having a top surface 22 and an underside 21, the top surface 22 defining a concave section 15, the support tray having a first edge 23, a second edge 25 and two side edges. The first edge 23 curves towards the underside 21 to define a first groove 28 and the second edge 25 curves towards the underside 21 to define a second groove 29. The supporting members comprise at least two frames 80*a*, 80*b* as seen in FIG. 6. The components of the frame can comprise one integral, rectangular frame or can be comprised of four or more multiple components. The first frame 80*a* comprises a first top member 82 and a first bottom member 90 and two side members 87, 88 connecting the first top member 82 to the first bottom member 90. The side members 87, 88 comprise a first side leg 87 and a second side leg 88. A second frame 80*b* comprises a second top member 84 and a second bottom member 91 and two second-side members 85, 86 connecting the second, top member 84 to the second bottom member 91. The two second-side members comprising a third side leg 85 and a fourth side leg 86. The first side leg 87 is pivotally connected to the third side leg 85 and the second side leg 88 is pivotally connected to the fourth side leg 86. The first and second top members 82, 84 are precisionally machined to fit within the grooves of the support tray 20. The supporting frames of the embodiment of FIG. 6 can be used with the support tray 20 of FIG. 1 or the support tray 120 as illustrated in FIG. 5.

In an alternative embodiment as illustrated in FIG. 7, two trays 220, 240 are used, one tray 220, 240 at either end of the leg assembly. The tray 220, 240 of this limb rest 200 can comprise a transverse slot 239 with notches 234, 236, 237 238. In this embodiment, the trusses (not shown) can slide through the transverse slot 239 and be positioned in the various notches 234, 236, 237, 238 thereby varying the height of the limb rest 200. The top tray 220 is slanted for improved circulation through the limb in lengthy medical procedures. A second, different sized tray 240 is provided to allow for various sized limb requirements.

The foregoing description is illustrative and explanatory of preferred embodiments of the invention and variations in the size, shape, materials and other details will become apparent to those skilled in the art, It is intended that all such variations and modifications which fall within the scope r spirit of the appended claims be embraced thereby.

What is claimed is:

1. A medical limb rest for elevating a body appendage comprising a support tray having a top surface and an underside, the top surface defining a concave section, the support tray having a first edge, a second edge opposite the first edge and two side edges;

the first edge curved towards the underside to define a first groove and the second edge curved towards the underside to define a second groove;

at least two pairs of legs, a first pair and a second pair, the first pair of legs comprising a first leg pivotally connected to a second leg, the second pair of legs comprising a third leg pivotally connected to a fourth leg, each leg having a top end and a bottom end;

a first truss connecting the top end of the first leg to the top end of the fourth leg;

a second truss connecting the second leg to the top end of the third leg;

the first truss and second truss precisionally machined to snugly fit within the grooves.

2. The medical limb rest of claim 1 wherein the support tray further comprises a sterile pad positioned within the concave section.

3. The medical limb rest of claim 1 wherein the support tray further comprises a plate, the plate comprising a top surface and a bottom surface, the top surface securely attached to the underside of the support tray, the plate further comprising a first lip at one end of the plate and a second lip at the opposite end of the plate, the first lip curving towards the bottom surface to define a third groove and the second lip curving towards the bottom surface to define a fourth groove.

4. The medical limb rest of claim 1 wherein the height of the limb rest is within a range of from about one inch to about fourteen inches.

5. The medical limb rest of claim 1 wherein each leg defines a pivot hole between the top end and the bottom end of the leg, the limb rest further comprising two or more removable pivot pins configured to be positioned within the pivot holes so that one pivot pin pivotally connects the first leg to the second leg and a second pivot pin pivotally connects the third leg to the fourth leg.

6. The medical limb rest of claim 5 wherein the pivot pin comprises a spring/ball assembly.

7. The medical limb rest of claim 5 wherein the pivot pins comprise snap rivets.

8. The medical limb rest of claim 5 wherein the pivot hole of each leg is positioned at a point on the leg that is within a range of approximately from about 25% to about 75% of the distance from the end of the leg.

9. The medical limb rest of claim 5 wherein the pivot hole of each leg is positioned approximately midway between the ends of the leg.

10. The medical limb rest of claim 5 wherein the pivot holes on the first and second leg are positioned at a distance from the end of the leg that is different from the distance of the pivot holes on the third leg and the fourth leg from the ends of the legs so that the tray, when snapped onto the legs, is at a slant.

11. The medical limb rest of claim 1 wherein a pivot pin comprises a single pivot shaft that connects all the legs to each other.

12. The medical limb rest of claim 1 wherein a third truss connects the bottom end of the first leg to the bottom end of the fourth leg, and a fourth truss connects bottom end of the second leg to the bottom end of the third leg; the third truss and the fourth truss precisionally machined to snugly fit within the grooves.

13. The medical limb rest of claim 1 wherein the limb rest is sterile.

14. The medical limb rest of claim 1 further comprising a second support tray.

15. A medical limb rest for elevating a body appendage, the medical limb rest comprising sterilized components, the sterilized components comprising:

a support tray having a top surface and an underside, the top surface defining a concave section, the support tray having a first edge, a second edge opposite the first edge and two side edges, a first side edge and a second side edge, the first side edge forming a first rim and the second side edge forming a second rim;

the first rim defining one or more slots positioned adjacent the first edge and one or more slots positioned adjacent the second edge, the distance of the slots from the first edge being equal to the distance of the slots from the second edge;

the second rim defining one or more slots positioned adjacent the first edge and one or more slots positioned adjacent the second edge, the distance of the slots from the first edge being equal to the distance of the slots from the second edge, the distance of the slots from either the first edge or the second edge on the first rim being equal to the distances of the slots from either the first edge or the second edge on the second rim so that the equidistant slots on each rim forms a pair of slots;

at least two pairs of legs, a first pair and a second pair, the first pair of legs comprising a first leg pivotally connected to a second leg, the second pair of legs comprising a third leg pivotally connected to a fourth leg; each leg having a top end and a bottom end;

a first truss connecting the top end of the first leg to the top end of the fourth leg;

a second truss connecting the second leg to the top end of the third leg;

the first truss and the second truss precisionally machined to snugly fit within the slots, the first truss for engaging with one of the pair of slots positioned adjacent the first edge and equidistant from the first edge and the second truss for engaging with a pair of slots positioned adjacent the second edge and equidistant from the second edge such that engaging the truss with the slots at varying distances from the edges varies the height of the tray.

16. The medical limb rest of claim 15 wherein each leg defines one or more pivot holes adapted to receive a pivot pin, the distances of the pivot holes from the ends of each of the legs being equal so that changing the position of the pivot pin to a different pivot hole on a leg changes the height of the limb rest.

17. A medical limb rest for elevating a body appendage, the medical limb rest comprising sterilized components, the sterilized components comprising:

a support tray having a top surface and an underside, the top surface defining a concave section, the support tray having a first edge, a second edge and two side edges, a first side edge and a second side edge, the first side edge forming a first rim and the second side edge forming a second rim;

at least two pairs of legs, a first pair and a second pair, the first pair of legs comprising a first leg pivotally connected to a second leg, the second pair of legs comprising a third leg pivotally connected to a fourth leg; each leg having a top end and a bottom end;

the first rim defining one or more slots positioned adjacent the first edge and one or more slots positioned adjacent the second edge, the distance of the slots from the first edge being equal to the distance of the slots from the second edge;

the second rim defining one or more first edge slots positioned adjacent the first edge and one or more second edge slots positioned adjacent the second edge, the distance of the first edge slots from the first edge being equal to the distance of the second edge slots from the second edge, the distance of the slots from the first or second edges on the first rim being equal to the distances of the slots from the first or second edges on the second rim;

the top ends of the first leg and the third leg precisionally machined to snugly fit within the slots adjacent the first edge and the top ends of the second leg and the fourth leg precisionally machined to snugly fit within the slots adjacent the second edge.

18. The medical limb rest of claim 17 wherein each leg defines one or more pivot holes adapted to receive a pivot pin, the distances of the pivot holes from the ends of each of the legs being equal so that changing the position of the pivot pin to a different pivot hole on a leg changes the height of the limb rest.

19. A medical limb rest for elevating a body appendage, the medical limb rest comprising:

a support tray having a top surface and an underside, the top surface defining a concave section, the support tray having a first edge, a second edge and two side edges;

the first edge curved towards the underside to define a first groove and the second edge curved towards the underside to define a second groove;

at least two frames, a first frame comprising a first top member and a first bottom member and two side members connecting the first top member to the first bottom member, the side members comprising a first side leg and a second side leg, and a second frame comprising a second top member and a second bottom member and two second side members connecting the second top member to the second bottom member, the two second side members comprising a third side leg and a fourth side leg wherein the first side leg is pivotally connected to the third side leg and the second side leg is pivotally connected to the fourth side leg;

the first top member and second top member being precisionally machined to fit within the grooves.

20. The medical limb rest of claim 19 further comprising a plate comprising a top surface and a bottom surface, the top surface, securely attached to the underside of the support tray, the plate further comprising a first lip at one end of the plate and a second lip at the opposite end of the plate, the first lip curving toward the bottom surface to define a third groove and the second lip curving toward the bottom surface to define a forth groove.

* * * * *